US005915480A

United States Patent [19]

Yemelyanov et al.

[11] Patent Number: 5,915,480

[45] Date of Patent: Jun. 29, 1999

[54] FIRE EXTINGUISHING SYSTEM

[75] Inventors: Valeryj Nilovich Yemelyanov; Aleksey Ivanovich Sidorov; Vyacheslav Vasilyevich Prosyanyuk, all of Moskovskaya oblast; Valeryj Nikolaevich Kozyrev, Moscow, all of Russian Federation

[73] Assignee: R-Amtech International, Inc., Bellevue, Wash.

[21] Appl. No.: 08/932,922

[22] Filed: Sep. 18, 1997

[30] Foreign Application Priority Data

Sep. 20, 1996 [DE] Germany ..... 196 38 626

[51] Int. Cl.[6] ..... A62C 37/10

[52] U.S. Cl. ..... 169/61; 169/56

[58] Field of Search ..... 169/28, 42, 55, 169/56, 57, 60, 61, 62; 239/66

[56] References Cited

U.S. PATENT DOCUMENTS

| | | | |
|---|---|---|---|
| 3,726,344 | 4/1973 | Rothman et al. | 169/61 X |
| 3,811,511 | 5/1974 | McCulloch | 169/28 |
| 3,878,897 | 4/1975 | Goffart . | |
| 3,917,001 | 11/1975 | Davis et al. | 169/61 |
| 4,013,128 | 3/1977 | Davis | 169/61 |
| 4,359,097 | 11/1982 | Claussen | 169/61 |
| 4,597,451 | 7/1986 | Moore et al. | 169/61 |
| 5,622,225 | 4/1997 | Sundholm | 169/61 |

FOREIGN PATENT DOCUMENTS

| | | |
|---|---|---|
| 30 21 753 C2 | 12/1980 | Germany . |
| 44 28 308 A1 | 2/1996 | Germany . |
| 2018782 | 8/1994 | Russian Federation . |
| 1546087 A1 | 2/1990 | U.S.S.R. . |
| 2028 127 | 3/1980 | United Kingdom . |

OTHER PUBLICATIONS

Formgedaechtnislegierungen Fuer Moderne Problemloesungen, Technische Rundschau, Feb. 1, 1991, May 1991 pp. 30–39.

*Primary Examiner*—Andres Kashnikow
*Assistant Examiner*—Steven J. Ganey
*Attorney, Agent, or Firm*—Griffin, Butler Whisenhunt & Szipl, LLP

[57] ABSTRACT

A fire extinguishing system has one or more extinguishing units (1) connected together. A heat detector (2) in each extinguishing unit acts as a device for detecting a fire and as a device for triggering an extinguishing process with the aid of a fire extinguishing device (3), which generates a fire extinguishing aerosol spray during the fire. In addition, an electric ignitor (5) and a pyrotechnic electric generator (4) is in each extinguishing unit, and—if several extinguishing units are provided—each pyrotechnic electric generator (4) is connected via wiring (6) to all ignitors (5) in the other extinguishing units. A sensor element of the heat detector (2) consists preferably of a fusible material or of a material with shape memory characteristics. The fire extinguishing system provides a high degree of operational reliability in detecting fires and in extinguishing fires at initial stages, while maintaining favorable characteristics in stand-by operation.

2 Claims, 1 Drawing Sheet

FIRE EXTINGUISHING SYSTEM

BACKGROUND OF THE INVENTION

This invention relates to a fire extinguishing system of a type including several extinguishing units connected together, each having a heat detector for detecting an outbreak of a fire and for triggering an extinguishing process and an electric ignitor.

German patent document (DE 44 28 308 A1) discloses a fire extinguishing system having several fire extinguishing units joined together each having a device for detecting a fire and a device for triggering a fire extinguishing process. Each fire extinguishing unit of the extinguishing system disclosed in German patent document (DE 44 28 308 A1) has a heat detector and an electric ignitor for detecting the fire and for triggering the fire extinguishing process. In the fire extinguishing system disclosed in German patent document (DE 44 28 308 A1), water or foam is used as an extinguishing material. The fire extinguishing system disclosed in German patent document (DE 44 28 308 A1) is suitable only for extinguishing local fires or surface fires. The extinguishing material is conveyed to the individual extinguishing units in the fire extinguishing system disclosed in German patent document (DE 44 28 308 A1) via a network of pipes. Destruction of this network of pipes at any one point may keep many or all of the extinguishing units from being supplied with extinguishing material. Therefore, operational reliability, specifically long-term operational reliability, of the fire extinguishing system disclosed in German patent document (DE 44 28 308 A1) is poor. Furthermore, according to German patent document (DE 44 28 308 A1), power for the electric ignitor is supplied by an external source, which further detracts from the operational reliability of this fire extinguishing system.

German patent document (DE 30 21 753 C2) discloses a fire extinguishing system having a plurality of extinguishing units and one central tripping device. Each extinguishing head of the fire extinguishing system disclosed in German patent document (DE 30 21 753 C2) is connected to the central tripping device. Use of a single central tripping device severely impairs operational reliability of the fire extinguishing system disclosed in German patent document (DE 30 21 753 C2). Specifically, if the operation of the central tripping device is interrupted, the entire fire extinguishing system goes out of operation immediately because there is no system redundancy.

Russian patent document (SU-A 1 546 087) discloses an automatic fire extinguishing system with devices for detecting a fire, extinguishing devices, initiation devices, and devices for linking them together. Main disadvantages of this system are its conditional autonomy and a need for regular inspections of fire extinguishers and of starting and shut-off mechanisms, as well as a very poor extinguishing capacity of the system in comparison with fire extinguishing devices using aerosols as extinguishing measures.

British patent document (GB-A-2 028 127) discloses a fire extinguishing system having a device for generating fire extinguishing material during operation, and a device for detecting a fire and for triggering the fire extinguisher, which partly overcomes the disadvantages outlined above. However, the effectiveness of this system is inadequate, mainly because of a relatively low extinguishing potential of gaseous products of combustion, which function primarily as inert diluting agents, reducing oxygen concentrations to a level below a threshold of combustibility. The devices for detecting fires and triggering the fire extinguisher are also quite sluggish.

United States patent document (U.S. Pat. No. 3,878,897) discloses a fire extinguishing system having one or more extinguishing units connected together, each of which has a device for detecting a fire and a device for triggering an extinguishing process.

The main disadvantages of this fire extinguishing system are its poor sensitivity and functional reliability, which are further reduced during operation of the system over an extended ready stand-by period. This negative effect results from the fact that detonation cord is used as a device for detecting an outbreak of a fire, and for triggering and connecting the fire extinguishing system.

A detonation cord of any composition can be ignited only through direct contact with flames within a specific period of time. This means that the disclosed system can trigger the start of an extinguishing process only at a stage when a fire has already developed.

The likelihood that flames from a fire in its initial stages will come into contact with the detonation cord is quite small (an area to be protected is incomparably larger than a surrounding area of the detonation cord). Furthermore, the detonation cord is exposed to effects of humidity and dust, and influences of differences in air temperature related to time of day and season, which makes the detonation cord sluggish; consequently the flammability and response speed of the entire system is reduced. It is practically impossible to protect detonation cord from these negative factors, because such protection would significantly reduce sensitivity for fire detection and, ultimately, would also limit operational reliability of the system. In many cases, specifically relating to effects of corrosive and/or oil-saturated materials, local overheating, etc. may cause the cord to ignite spontaneously, and the fire extinguishing system may respond at a wrong time. Furthermore, the mechanical strength ofthe detonation cord is low, and is reduced even further over time, so that the cord may break, accidentally or on its own, becoming unusable. To keep the system in operational readiness, the detonation cords must be inspected regularly (conforming to specifications), and must be replaced as necessary.

It is an object of this invention to provide a fire extinguishing system with increased operational reliability for detecting a fire and for extinguishing the fire in its initial stages, while retaining advantageous characteristics of the system when it is in stand-by operation throughout an entire guarantee term, minimally however 10 to 15 years, and with automatic notification of a start of operation of the system to a control panel, warning-signal systems, etc.

SUMMARY

According to principles of this invention, each extinguishing unit of a plurality of extinguishing units of an extinguishing system has a pyrotechnic generator, each pyrotechnic generator being connected via an electric circuit (wiring) to ignitors of all the other extinguishing units.

BRIEF DESCRIPTION OF THE DRAWING

The invention is described and explained in more detail below using an embodiment shown in the drawing. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawing. The drawing is not necessarily to scale, emphasis instead being placed upon illustrating principles of the invention in a clear manner.

DESCRIPTION OF THE PREFERRED EMBODIMENT

Figure 1:
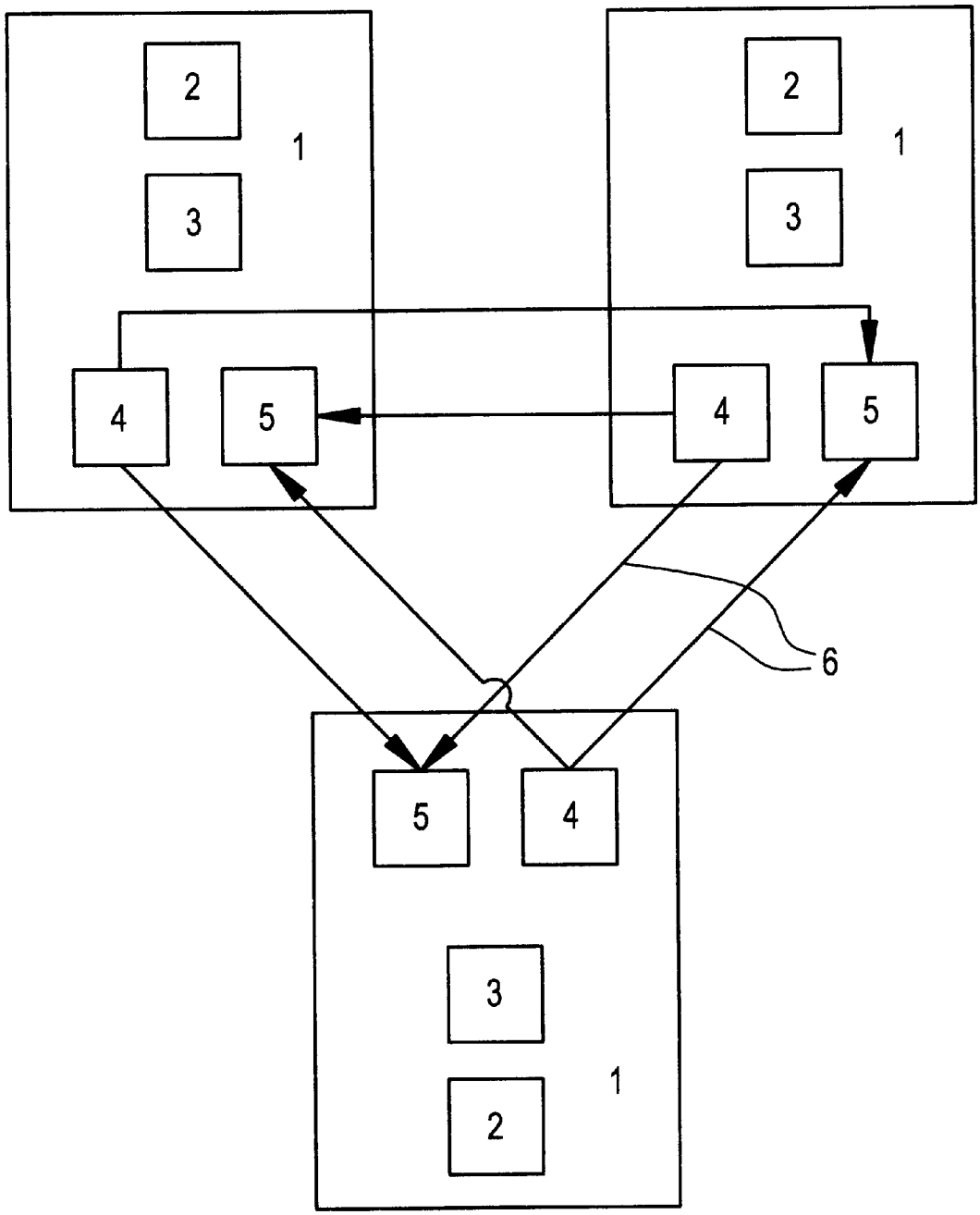
FIG. 1 is a block diagram showing a fire extinguishing system of this invention.

Each extinguishing unit 1, which is connected together with other extinguishing units 1 to form a fire extinguishing system, has a fire extinguishing device 3 which generates a fire extinguishing aerosol spray during a fire, a device for detecting an outbreak of a fire and for triggering an extinguishing process which is designed as a heat detector 2, a pyrotechnic electric generator 4, and an electric ignitor 5, whereby the pyrotechnic electric generator of each unit is connected in parallel or in series via electrical wiring 6 to all ignitors in the other extinguishing units.

The pyrotechnic electric generator is a device for converting chemical energy of an exothermal mass into electrical energy. Pyrotechnic electric generators as such are known in the art, e.g. as high-temperature supply sources of direct current to self-supportingly power on-board equipment in specialized vehicles. Such pyrotechnic electric generators normally remain in stand-by status, and go into operation only under special circumstances.

Russian patent document (2018782) discloses a pyrotechnic electric generator, for example. In this pyrotechnic electric generator, two electrodes are made as compressed charges (half-charges). An anode is a pyrotechnic charge with an excess of fuel, and a cathode is a pyrotechnic charge with an excess of oxidation material. A separator, which separates the anode and the cathode, is made of a porous dielectric material. The cathode is made from a mixture of lead fluoride, lithium fluoride, and aluminum fluoride, the anode of a mixture of lead fluoride, magnesium fluoride, and lithium fluoride. After both half charges of this pyrotechnic electric generator are ignited, an electrical charge carrier flow is generated.

Operation of the fire extinguishing system of this invention is described in further detail below. When a source of fire occurs (when fire breaks out), there is an increase in air temperature in a space to be protected. When a sensor element of a heat detector 2 is heated to a threshold value (for example, to a temperature of 70° C.), there is an automatic release of a safety of the unit, due to loss of rigidity of fusible materials from melting, and an ignition capsule responds; its ignition surge assuring initiation of the pyrotechnic material 3 that generates a fire extinguishing aerosol spray during a fire in a housing of the fire extinguishing unit 1 (at the same time, the pyrotechnic electric generator 4 can also be in operation). The sensor element of the heat detector 2 can also be made of a material with shape memory characteristics. When the sensor element (made of nitinol or of another similar alloy) is heated to a threshold temperature, of 70° C., for example, the sensor element (the safety) assumes a predetermined shape, automatically removing the safety and causing the ignition capsule to respond.

When the pyrotechnical material 3 burns, products of combustion (ultra-finely dispersed aerosol particles) are ejected, extinguishing the fire. The system of this invention is highly effective because it permits detection of the outbreak of a fire in its earliest stage, and begins automatic extinguishing of the fire no later than 30 sec. after the predetermined critical temperature is reached at the sensor element of the heat detector 2. The melting temperature of the alloys and the phase-transition temperature of the materials having shape memory characteristics remain unchanged during an entire life of the sensor.

When the pyrotechnic material 3 is triggered in the extinguishing unit 1 that responds first, the pyrotechnic electric generator 4 is simultaneously set into operation, sending electrical energy it generates through the wiring 6 to all ignitors 5 in the other extinguishing units 1, setting them into operation and (as necessary) triggering a fire alarm system (incandescent lamps, bells, buzzers, generators for generating warning signals, switches on relays, etc.).

Because of the characteristic features of this invention, the electric ignitors (or the fire extinguishing devices) can be operated automatically, simultaneously or in a specific sequence, at any time of day or night, regardless of an initial temperature, humidity, etc., within the guarantee term. The fire extinguishing aerosol is thereby generated in a required concentration within as short a period oftime as possible throughout an entire space to be protected, so that the source of the fire is prevented from developing into a full fire and materials are not permitted to burn or smolder.

The fire extinguishing system of this invention is effective in extinguishing gaseous, liquid, and solid fuels in rooms, trains, and motor vehicles, in seagoing vessels and river boats, and in aircraft, and makes it possible to fix positions of fires; it also prevents specially-set fires from resulting in explosions in storage and operational spaces that are at risk of fires and explosions.

The effectiveness of a fire extinguishing system of this invention in initial stages of a fire is improved and a guaranteed stand-by operation term, at an ambient temperature of 60° C. and relative humidity of up to 98%, is increased to 10 to 15 years.

A system based on principles of this invention triggers a start of a fire extinguishing process regardless of the position of a heat detector in a space to be protected; so that shields (screens, shelves, partition walls, conveyors, etc.) located between the source of fire and a device for detecting the fire do not have any significant effect on the operational response of the system, since the detector is released by the safety as soon as the temperature of the surrounding air reaches a preset threshold value. This occurs through loss of mechanical strength (melting) of an easily fusible material, or when a sensor element in the heat detector (e.g. an element made of a material with a shape memory) assumes a predetermined shape when the temperature threshold is reached. Furthermore, by simultaneously generating a fire-extinguishing aerosol and an electrical current when the fire extinguishing system of this invention responds to presence of a source of fire, the system not only assures automatic activation of other devices for extinguishing the fire, but it also triggers warning, signaling, and shut-off devices and systems and the like, such as generators for generating warning signals (e.g. a "signal horn"), relays, lights, electric motors, etc., which are located on a control panel, in service areas, etc.

A pyrotechnic electric generator acts as a reserve or emergency power source; its anode and cathode are made of pyrotechnic compounds with a high degree of heat-surge sensitivity (fire-surge sensitivity).

A structure of the pyrotechnic electric generator and component parts of its compounds allow for conversion of chemical energy of the pyrotechnic electrodes into electrical energy during the fire. Once the detector responds (ignition of the charge), a time in which a maximum value of electromotive force, current strength and voltage, is achieved does not exceed 0.1 to 0.5 sec. The output of the pyrotechnic electric generator is sufficient for transmitting generated electrical energy through wiring up to a distance of 500 m, for purposes of setting into operation one or more connected electric ignitors of any kind whatsoever, and to provide short-term power (1 to 10 sec.) to warning, signaling, and shutting-off systems, and the like.

In a preferred embodiment of the fire extinguishing system of this invention, the sensor of the heat detector is made either of an easily fusible material (an alloy according to Wood, Rose, or Newton, or another alloy) or of a material with shape memory characteristics in a temperature range of 70 to 150° C. (nitinol, etc.).

While the invention has been particularly shown and described with reference to a preferred embodiment, it will be understood by those skilled in the art that various changes in form and detail may be made therein without departing from the spirit and scope of the invention.

The invention claimed is:

1. A fire extinguishing system comprising a plurality of extinguishing units connected together, each having a heat detector for detecting outbreak of a fire and for triggering an extinguishing process by the extinguishing unit, and an electric ignitor for also triggering the extinguishing process, wherein each extinguishing unit further has a pyrotechnic electric generator, each pyrotechnic electric generator being connected via an electric wiring circuit to the electric ignitors of all other extinguishing units for transmitting electric energy thereto to trigger the electric ignitors.

2. A fire extinguishing system as in claim 1, wherein a sensor element of the heat detector is made of one of a fusible material and a material with shape memory characteristics.

* * * * *